US007399152B2

(12) United States Patent
Domijan

(10) Patent No.: US 7,399,152 B2
(45) Date of Patent: Jul. 15, 2008

(54) APPARATUS FOR DOUBLE SEAMING CONTAINERS

(75) Inventor: Joseph J. Domijan, Downers Grove, IL (US)

(73) Assignee: Crown, Cork & Seal Technologies Corportion, Alsip, IL (US)

( * ) Notice: Subject to any disclaimer, the term of this patent is extended or adjusted under 35 U.S.C. 154(b) by 903 days.

(21) Appl. No.: 10/274,797

(22) Filed: Oct. 21, 2002

(65) Prior Publication Data

US 2004/0076494 A1 Apr. 22, 2004

(51) Int. Cl.
*B21D 51/32* (2006.01)

(52) U.S. Cl. ..... 413/31; 413/41

(58) Field of Classification Search ..... 413/31, 413/40, 41

See application file for complete search history.

(56) References Cited

U.S. PATENT DOCUMENTS 1,695,210 A * 12/1928 Sedwick ..... 413/40
3,025,814 A * 3/1962 Currie et al. ..... 413/31
4,574,607 A 3/1986 Akino et al.
5,049,019 A 9/1991 Franek et al.
5,320,469 A 6/1994 Katou et al.
5,860,782 A 1/1999 Campbell
5,911,551 A 6/1999 Moran
5,911,552 A 6/1999 Shimizu et al.
5,957,647 A 9/1999 Hinton

* cited by examiner

*Primary Examiner*—Shelley Self
(74) *Attorney, Agent, or Firm*—Knoble, Yoshida, & Dunleavy, LLC

(57) ABSTRACT

An apparatus for double seaming an end unit to a can body includes, as is conventional, a double seaming chuck, a double seaming roll and a mechanism for selectively moving the double seaming roll toward the double seaming chuck to perform a double seaming operation. Most advantageously, a drive mechanism is provided for driving the double seaming chuck and the double seaming roll at respective speeds that are selected so as to reduce relative rotational speed between the double seaming roll and a workpiece when the double seaming roll comes into contact with the workpiece during the double seaming operation.

9 Claims, 3 Drawing Sheets

APPARATUS FOR DOUBLE SEAMING CONTAINERS

BACKGROUND OF THE INVENTION

1. Field of the Invention

This invention relates generally to the field of packaging and containers, and, more specifically, to the manufacturing of cans using the double seaming process.

2. Description of the Related Technology

Conventionally, cans are sealed by applying a lid using the well-known double seaming process. This is most typically performed on a rotational type machine having multiple spindles. Each spindle or station contains a seaming chuck which acts as an anvil to support the can end unit while two freely rotating round seaming rolls are brought into contact towards the can axis using a cam motion. Each of the seaming rolls is formed with specific groove geometry to work the metal into what is a commercially accepted double seam. The seaming rolls are mounted in bearings and are rotated coincident to contact with the can body and the end unit. This diameter is reduced in the act of double seaming and leaves a smooth, well rounded edge to the juncture of the can body and end unit. Latest metals technology has allowed for plastic laminates and specialized coatings to be applied to the steel. This protects the steel from oxidation in wet, damp environments. However, these laminates and coatings are upset in the double seaming process. Due to the nature of metal formation, heat is produced in each of the two seaming operations. This resultant heat produced in the first operation of seaming softens the laminate or coating and sets it up for damage in the second operation. The mode of failure is caused by the transfer of inertia to the second operation seaming roll while the coating or laminate is thermally elevated. Performing the second operation double seam generates even more thermal load allowing even more damage to the coating or laminate after contact.

A need exists for an improved system and method for seaming containers that is less destructive to the coating or laminate on the metal than are the systems and methods conventionally in use.

SUMMARY OF THE INVENTION

Accordingly, it is an object of the invention to provide an improved system and method for seaming containers that is less destructive to the coating or laminate on the metal than are the systems and methods conventionally in use.

In order to achieve the above and other objects of the invention, an apparatus for double seaming an end unit to a can body includes, according to a first aspect of the invention, a double seaming chuck; a first drive mechanism operably connected to the double seaming chuck for rotating the double seaming chuck; a double seaming roll; means for selectively moving the double seaming roll toward the double seaming chuck to perform a double seaming operation; and a second drive mechanism for rotating the double seaming roll in a direction so as to reduce relative rotational speed between the double seaming roll and a workpiece when the double seaming roll comes into contact with the workpiece during the double seaming operation.

According to a second aspect of the invention, an apparatus for double seaming an end unit to a can body includes a double seaming chuck; a double seaming roll; structure for selectively moving the double seaming roll toward the double seaming chuck to perform a double seaming operation; and rotational drive structure for driving the double seaming chuck and the double seaming roll at respective speeds that are selected so as to reduce relative rotational speed between the double seaming roll and a workpiece when the double seaming roll comes into contact with the workpiece during the double seaming operation.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
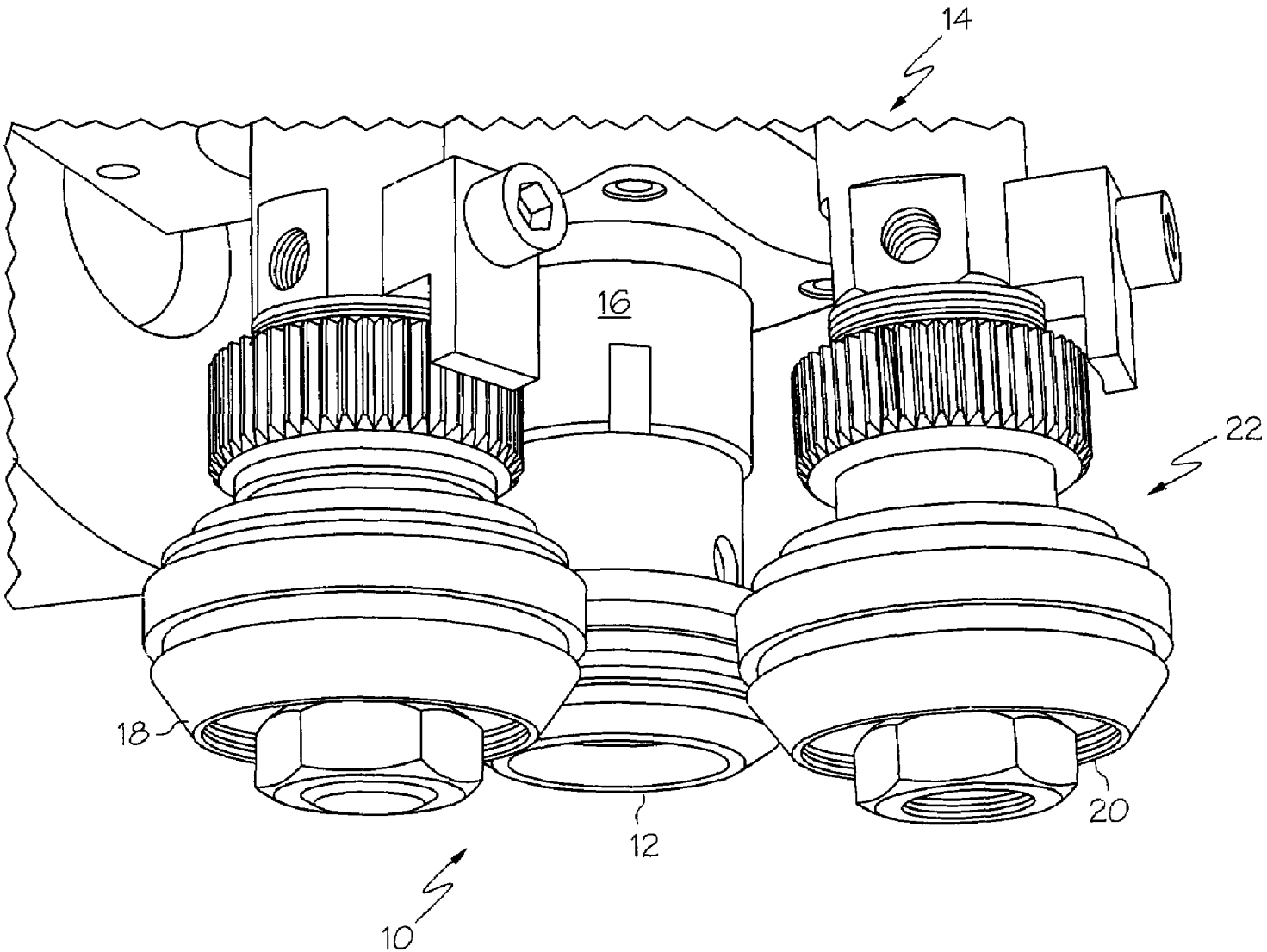
FIG. 1 is a perspective view of an apparatus that is constructed according to a first embodiment of the invention.

Referring now to the drawings, wherein like reference numerals designate corresponding structure throughout the views, and referring in particular to FIG. 1, an apparatus 10 for double seaming an end unit to a can body includes a double seaming chuck 12 that is constructed and arranged, as conventional, to fit into a recessed part of the can end or end unit so as to clamp the end unit to a can body when the can body is lifted upwardly toward the double seaming chuck 12 by means of a lifter plate or equivalent mechanism, as is well-known in this area of technology. A novel and advantageous drive mechanism 14 for driving the double seaming chuck 12 and at least one of the double seaming rolls, as will be discussed in greater detail below, includes a conventional first drive mechanism 16 that is operably connected to the double seaming chuck 12 for rotating the double seaming chuck 12 during the first and second double seaming operations.

Figure 4:
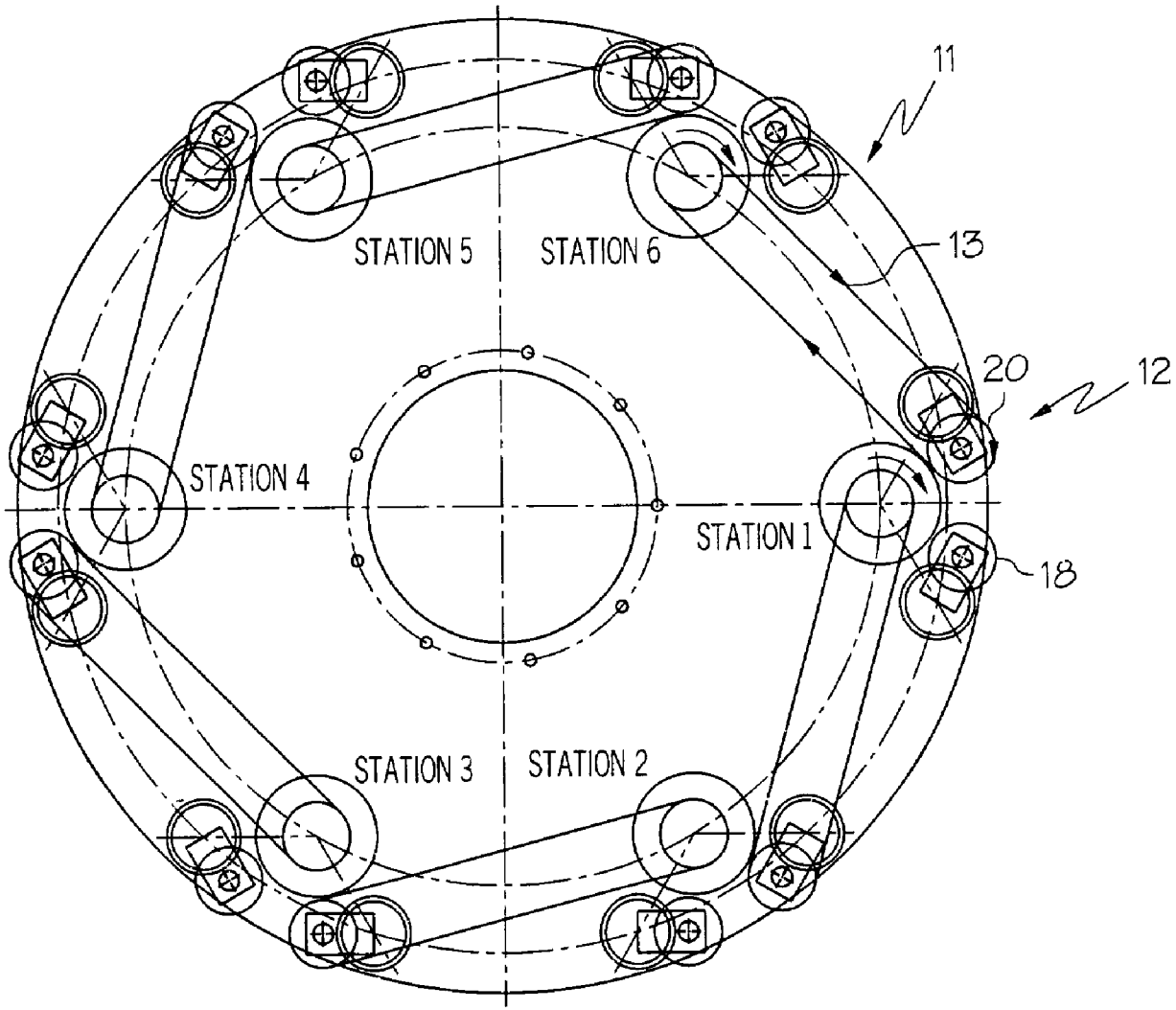
FIG. 4 is a diagrammatical view depicting an overall system according to the invention.

As may be seen in FIG. 1, apparatus 10 further includes a first double seaming roll 18 that is constructed and arranged to perform a first double seaming operation on a workpiece consisting of a can body and a can end, and a second double seaming roll 20 that is constructed and arranged to perform a second double seaming operation on the workpiece. The drive mechanism 14 includes, as conventional, cam mechanisms for moving the first double seaming roll 18 into operative position relative to the double seaming chuck 12 during the first operation, and later moving the second double seaming roll 20 into operative position relative to the double seaming chuck 12 during the second operation. Such cam mechanisms are conventional, and are well-known to skilled artisans in this area of technology. FIG. 4 depicts an overall system 11 containing several apparatuses 10, each of which is driven by a drive belt 13.

According to one advantageous aspect of the invention, drive mechanism 14 further includes a second drive mechanism 22 that is constructed and arranged to rotate the double seaming roll 20 in a direction so as to reduce relative rotational speed between the double seaming roll 20 and the workpiece when the double seaming roll 20 comes into contact with the workpiece during the second double seaming operation. In the preferred embodiment, second drive mechanism 22 is constructed and arranged so as to reduce this relative rotational speed to substantially zero. By reducing or eliminating the relative speed between the double seaming roll 20 and the workpiece, the likelihood of damage to the coating or laminate that has otherwise been found to occur during the initial contact of the double seaming roll and the workpiece will be greatly reduced.

Figure 3:
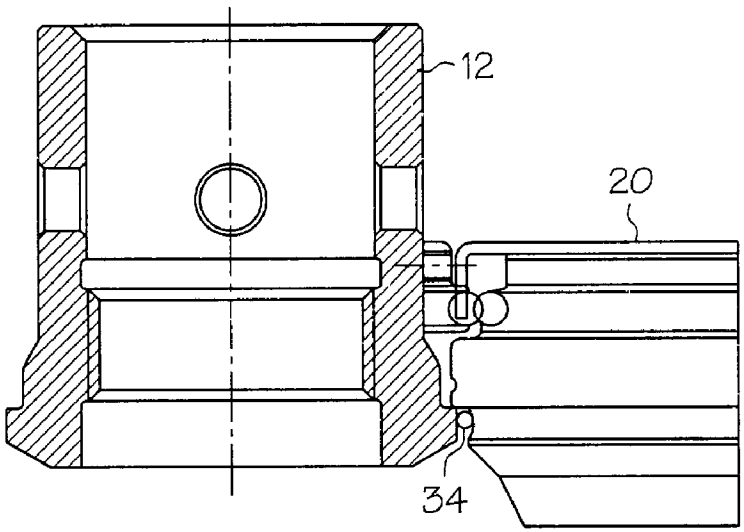
FIG. 3 is a fragmentary cross-sectional view similar to that of FIG. 2, showing the apparatus in a second operational position.
Figure 2:
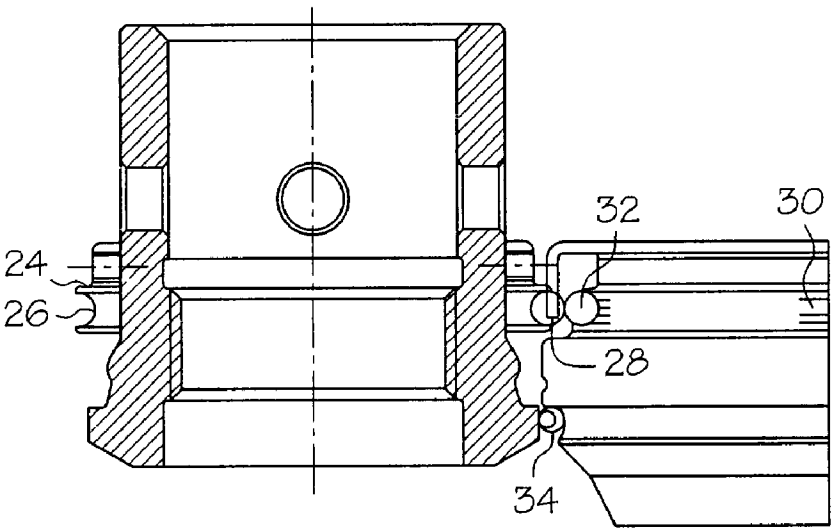
FIG. 2 is a fragmentary cross-sectional view depicting a portion of the apparatus that is shown in FIG. 1, shown in a first operational position.

Referring now to FIGS. 2 and 3, second drive mechanism 22 is in the preferred embodiment constructed and arranged to be normally disengaged, and to become engaged as the double seaming roll 20 is moved toward the double seaming chuck 12 prior to performing the second operation of the double seaming operation. Moreover, the second drive mechanism 22 is constructed and arranged to frictionally engage in the double seaming chuck 12 in order to rotate the double seaming roll 20. As may be seen in FIGS. 2 and 3, second drive mechanism 22 includes a mounting boss 24 that is secured for rotation together with double seaming chuck 12 and that has an annular groove 26 defined in an outer circumferential surface thereof in which a resilient elastomeric O-ring 28 is positioned. Similarly, seaming roll 20 is machined or otherwise formed to have an annular groove 30 defined in an outer circumferential surface thereof, and a second resilient elastomeric O-ring 32 is positioned within this annular groove 30. As may be seen in FIGS. 2 and 3, the O-ring 28 will contact the O-ring 32 as the double seaming roll 20 is moved toward the double seaming chuck 12 prior to the initiation of the second operation, which is defined herein as beginning when the workpiece 34 is contacted by the respective tool portions of the chuck 12 and roll 20. This causes the double seaming roll 20 to rotationally accelerate, and the relative outer diameters of the respective O-rings 28,32 are selected so that a final rotational speed is achieved that is intended to precisely match the rotational speed of the outer circumference of the workpiece 34 at the time the outer circumference of the workpiece 34 contacts the tool portion of the double seaming roll 20.

Although in the preferred embodiment of the invention it is only the double seaming roll 20 for the second operation that is driven in order to reduce trauma to the workpiece, it should be understood that this principle could likewise or alternatively be applied within the scope of the invention to drive the double seaming roll 18 of the first operation. Also, in facilities that include a plurality of spindles or stations it might be advantageous for a number of different reasons for the drive mechanism for the double seaming rolls to be powered by the spindle or chuck 12 of an adjacent station, or by a ganged drive mechanism that is common to all stations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for double seaming an end unit to a can body, comprising:

a double seaming chuck;

a first drive mechanism operably connected to said double seaming chuck for rotating said double seaming chuck;

a double seaming roll;

means for selectively moving said double seaming roll toward said double seaming chuck to perform a double seaming operation;

a second drive mechanism for rotating said double seaming roll in a direction so as to reduce relative rotational speed between said double seaming roll and a workpiece when the double seaming roll comes into contact with the workpiece during the double seaming operation, said second drive mechanism being constructed and arranged to be normally disengaged, and to become engaged as the double seaming roll is moved toward the double seaming chuck to perform a double seaming operation;

wherein said second drive mechanism is constructed and arranged to engage said double seaming chuck in order to rotate said double seaming roll;

wherein said second drive mechanism comprises means for frictionally engaging said double seaming chuck prior to performing said double seaming operation;

wherein said second drive mechanism comprises a first frictional drive element that is mounted to rotate with said double seaming chuck and a second frictional drive element that is mounted to rotate with said double seaming roll, said first and second drive elements being oriented and configured so as to engage each other as said double seaming roll is moved toward said double seaming chuck prior to the double seaming operation; and wherein at least one of said first and second drive elements is elastomeric and compressible, whereby said first and second drive elements are capable of remaining engaged as the double seaming roll continues to move toward the double seaming chuck during the double seaming operation.

2. An apparatus according to claim 1, wherein said second drive mechanism is constructed and arranged to substantially eliminate relative rotational speed between the double seaming toll and the workpiece during the double seaming operation.

3. An apparatus for double seaming an end unit to a can body, comprising:

a double seaming chuck;

a double seaming roll;

means for selectively moving said double seaming roll toward said double seaming chuck to perform a double seaming operation;

rotational drive means for driving said double seaming chuck and said double seaming toll at respective speeds that are selected so as to reduce relative rotational speed between said double seaming roll and a workpiece when the double seaming roll comes into contact with the workpiece during the double seaming operation, and wherein said rotational drive means comprises a first drive mechanism for driving the double seaming chuck and a second drive mechanism for driving the double seaming roll, and wherein said second drive mechanism is constructed and arranged to be normally disengaged from said rotational drive means, and to become engaged as said double seaming roll is moved toward said double seaming chuck prior to performing said double seaming operation;

wherein said second drive mechanism is constructed and arranged to engage said double seaming chuck in order to rotate said double seaming roll;

wherein said second drive mechanism comprises means for frictionally engaging said double seaming chuck prior to performing said double seaming operation;

wherein said second drive mechanism comprises a first frictional drive element that is mounted to rotate with said double seaming chuck and a second frictional drive element that is mounted to rotate with said double seaming roll, said first and second drive elements being oriented and configured so as to engage each other as said double seaming roll is moved toward said double seaming chuck prior to the double seaming operation; and wherein at least one of said first and second drive elements is elastomeric and compressible, whereby said first and second drive elements are capable of remaining engaged as the double seaming toll continues to move toward the double seaming chuck during the double seaming operation.

4. An apparatus according to claim 3, wherein said second drive mechanism is constructed and arranged to substantially eliminate relative rotational speed between the double seaming roll and the workpiece during the double seaming operation.

5. An apparatus for double seaming an end unit to a can body, comprising:

a double seaming chuck;

a first drive mechanism operably connected to said double seaming chuck for rotating said double seaming chuck;

a double seaming roll;

means for selectively moving said double seaming roll toward said double seaming chuck to perform a double seaming operation; and a second drive mechanism for rotating said double seaming roll in a direction so as to reduce relative rotational speed between said double seaming roll and a workpiece when the double seaming roll comes into contact with the workpiece during the double seaming operation, said second drive mechanism comprising a first elastomeric frictional drive element that is mounted to rotate with said double seaming chuck and a second elastomeric frictional drive element that is mounted to rotate with said double seaming roll, said first and second drive elements being oriented and configured so as to engage each other as said double seaming roll is moved toward said double seaming chuck prior to the double seaming operation.

6. An apparatus according to claim 5, wherein at least one of said first and second drive elements is compressible, whereby said first and second drive elements are capable of remaining engaged as the double seaming roll continues to move toward the double seaming chuck during the double seaming operation.

7. An apparatus according to claim 5, where in said first drive element comprises an O-ring.

8. An apparatus according to claim 7, where in said second drive element comprises an O-ring.

9. An apparatus for double seaming an end unit to a can body, comprising:

a double seaming chuck;

a first drive mechanism operably connected to said double seaming chuck for rotating said double seaming chuck;

a double seaming roll;

means for selectively moving said double seaming roll toward said double seaming chuck to perform a double seaming operation; and a second drive mechanism for rotating said double seaming roll in a direction so as to reduce relative rotational speed between said double seaming roll and a workpiece when the double seaming roll comes into contact with the workpiece during the double seaming operation, said second drive mechanism comprising a plurality of O-rings.

* * * * *